US007772816B2

(12) United States Patent
Cho et al.

(10) Patent No.: US 7,772,816 B2
(45) Date of Patent: Aug. 10, 2010

(54) SYSTEMS, METHODS, AND APPARATUSES FOR IMPLEMENTING A LOAD REGULATION TUNER FOR LINEAR REGULATION

(75) Inventors: Changhyuk Cho, Roswell, GA (US); Chang-Ho Lee, Marietta, GA (US); Jaejoon Chang, Duluth, GA (US); Wangmyong Woo, Cumming, GA (US); Haksun Kim, Daejeon (KR); Joy Laskar, Marietta, GA (US)

(73) Assignees: Samsung Electro-Mechanics (KR); Georgia Tech Research Corporation, Atlanta, GA (US)

( * ) Notice: Subject to any disclaimer, the term of this patent is extended or adjusted under 35 U.S.C. 154(b) by 344 days.

(21) Appl. No.: 11/872,519

(22) Filed: Oct. 15, 2007

(65) Prior Publication Data

US 2008/0088286 A1 Apr. 17, 2008

Related U.S. Application Data

(60) Provisional application No. 60/829,562, filed on Oct. 16, 2006.

(51) Int. Cl.
*G05F 1/40* (2006.01)
*G05F 3/16* (2006.01)

(52) U.S. Cl. ..... 323/280; 323/315; 323/274

(58) Field of Classification Search ..... 323/269, 323/270, 273–275, 280, 315
See application file for complete search history.

(56) References Cited

U.S. PATENT DOCUMENTS

2004/0164815 A1* 8/2004 Hulfachor et al. ..... 331/185
2006/0113972 A1* 6/2006 Mihara ..... 323/273
2008/0001585 A1* 1/2008 Bakkaloglu et al. ..... 323/280

* cited by examiner

*Primary Examiner*—Jessica Han
(74) *Attorney, Agent, or Firm*—Sutherland Asbill & Brennan LLP

(57) ABSTRACT

Embodiments of the invention may provide for a load regulation tuner that reduces the load regulation effect. The load regulation tuner may include a load current controlled current source that is responsive to a load current from a power transistor of a linear regulator, where the load current controlled current source includes a sensing transistor that generates a fraction of the load current as a sensed partial load current. The load regulation tuner may also include a resistor in parallel with a load current controlled current source, and where the paralleled resistor and the load current controlled current source form at least a portion of a feedback block that adjusts an operation of the linear regulator to provide a substantially constant load voltage.

16 Claims, 6 Drawing Sheets

SYSTEMS, METHODS, AND APPARATUSES FOR IMPLEMENTING A LOAD REGULATION TUNER FOR LINEAR REGULATION

RELATED APPLICATION

The present application claims priority to U.S. Provisional Application Ser. No. 60/829,562, filed Oct. 16, 2006, and entitled "Systems, Methods, And Apparatuses For Implementing A Load Regulation Tuner for Linear Regulation," which is incorporated by reference in its entirety as if fully set forth herein.

FIELD OF THE INVENTION

The invention relates generally to a load regulation tuner for linear regulation, and more particularly to system, methods, and apparatuses for enhancing the performance of load regulation.

BACKGROUND OF THE INVENTION

A voltage regulator is a circuit that provides a constant DC voltage between its output terminals in spite of changes in the load current drawn from the output terminals and/or changes in the DC power supply voltage that feeds the voltage regulator circuit. FIG. 1A describes a simplified DC model of a voltage regulator. As shown in FIG. 1A, the equivalent circuit model of voltage regulators in DC domain can be described as an ideal voltage source $V_S$ in series with an internal source resistor $R_S$. The resistor $R_S$ represents an equivalent series resistance calculated from non-ideal effects inside the voltage regulator. FIG. 1B illustrate a typical topology of linear regulators in accordance with the prior art.

When non-ideal effects, such as input offset voltage, etc., are not dominant and ignored, the resistor $R_S$ is basically equal to the output resistance of the regulator. As the load current $I_L$ increases, there may be a non-ideal voltage drop $\Delta V_{LDR}$ (also referred to as the load regulation effect) across the source resistor $R_S$ as shown below in equation (1):

$$\Delta V_{LDR}=R_S\times\Delta I_L \tag{1}$$

As a result, the DC voltage drop $\Delta V_{LDR}$ over the desired regulator output voltage $V_S$ is proportional to both the resistance $R_S$ and the change in load current $\Delta I_L$. FIG. 2A illustrates the load regulation effect in the DC domain (Load regulation vs. $I_{LOAD}$), in accordance with the prior art. The load regulation effect in transient response in time domain is illustrated in FIG. 2B. Load regulation effect is a dominant factor determining the best accuracy a regulator can achieve over process corners for products, especially for high load current and low-voltage applications. The load regulation effect is proportional to the resistance $R_S$, which is approximately equal to the output resistance of the regulator, $\Delta V_{LDR}/\Delta I_L$. This means that the load regulation effect is minimized when the output resistance of the regulator decreases. Based on the typical linear regulator topology shown in FIG. 1B, the closed-loop output resistance $R_{O_REG}$, which is the actual output resistance of the regulator, can be described as:

$$R_{O_REG}=\frac{R_{O_op}}{1+A\beta} \tag{2}$$

$R_{O_op}$ refers to the open loop output resistance, A is the total gain of the regulator, and β is the feedback factor of the regulator. The total gain of the regulator is inversely proportional to the square root of the load current, Thus, as can be seen from equation (2), Ro_reg increases as the load current increases resulting in high load regulation effect. Therefore, the focus of load regulation effect issues has been on the increasing of loop gain to reduce output resistance of the voltage regulator. It can be seen from equation (2) that as Aβ increases, $R_{O_REG}$ decreases (i.e., $R_{O_REG}$ approaches zero).

In addition to reducing the load regulation effect, there is also a problem related to inter-connection voltage loss. Although inter-connection voltage loss is usually neglected by designers, the voltage loss due to resistors for inter-connection (including on-chip metal connection, off-chip bonding wire, metal connection, etc.) is another critical issue like the load regulation effect, which may cause significant effects in a heavy current load environment. FIGS. 3A and 3B illustrate typical connection resistance between a regulator and a load circuit where there is both an on-chip connection and an off-chip connection, in accordance with the prior art.

SUMMARY OF THE INVENTION

Embodiments of the invention may provide for a load regulation tuner that reduces the load regulation effect. The load regulation tuner may include a sensing transistor mirroring a ratio of the load current from the power transistor inside the linear regulator, a feedback loop improving the accuracy of the ratio between the load current of the power transistor and the sensed current of the sensing transistor, and a current mirror mirroring a sensed partial load current flowing into the load current control current source. The load regulation tuner may also include a resistor in parallel with the load current controlled current source, and the paralleled resistor is contained in a feedback block of at least one linear regulator. According to an aspect of the invention, a delay resistor and a delay capacitor may also be inserted between the gates of the current mirror to add a time delay. In accordance with yet another aspect of the invention, the feedback loop includes a resistor ladder.

According to another embodiment of the invention, there is a load regulation tuner comprising. The load regulation tuner may include a load current controlled current source that is responsive to a load current from a power transistor of a linear regulator, where the load current controlled current source includes a sensing transistor that generates a fraction of the load current as a sensed partial load current, and a current mirror connected to the sensing transistor and the power transistor for ensuring a substantially equal drain voltage for the sensing transistor and power transistor, thereby enhancing an accuracy of the sensing transistor in generating the fraction of the load current as the sensed partial load current. The load regulation tuner may also include a resistor in parallel with a load current controlled current source, and where the paralleled resistor and the load current controlled current source form at least a portion of a feedback block that adjusts an operation of the linear regulator to provide a substantially constant load voltage.

According to yet another example embodiment of the invention, there is a method for providing a load regulation tuner. The method may include providing a current source that is responsive to a load current from a power transistor of a linear regulator, where the load current controlled current source includes a sensing transistor that generates a fraction of the load current as a sensed partial load current, and a current mirror connected to the sensing transistor and the power transistor, thereby ensuring an accuracy of the sensing transistor in generating the fraction of the load current as the sensed partial load current. The method may also include providing a resistor in parallel with the current source, where at least a portion of the sensed partial load current is provided to the paralleled resistor, and where the paralleled resistor and the current source form at least a portion of a feedback block that adjusts an operation of the linear regulator to provide a substantially constant load voltage.

According to still another example embodiment of the invention, there is a system. The system may include a linear regulator having a first input port, a second input port, and an output port, where the first input port receives an input voltage reference, and where the output port provides a load voltage and a load current. The system may also include means for providing a feedback voltage signal to the second input port, where the means is connected in a feedback loop between the output port and second input port of the linear regulator, wherein the means includes at least an equivalent of a load current controlled current source and a resistor in parallel for adjusting the feedback voltage signal based upon a change in the load current to maintain the load voltage at a substantially constant level.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Embodiments of the invention may provide for a standalone load regulation tuner, which is capable of accurately canceling the load regulation effect and inter-connection voltage loss due to an inter-connection resistance for any type of linear regulator without affecting the regulator's stability and Power Supply Rejection Ratio (PSRR) performance. Further, the load regulation tuner may reduce or cancel the load regulation effect by tuning a DC feedback factor to reduce or cancel the load regulation effect as well as the inter-connection resistance loss for different load current and output voltage levels.

Embodiments of the invention will now be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
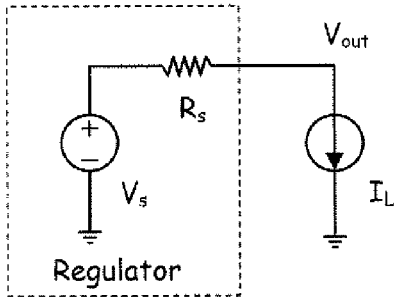
FIG. 1A (prior art)
FIG. 1A illustrates a simplified DC model of a voltage regulator in accordance with the prior art.
Figure 1B:
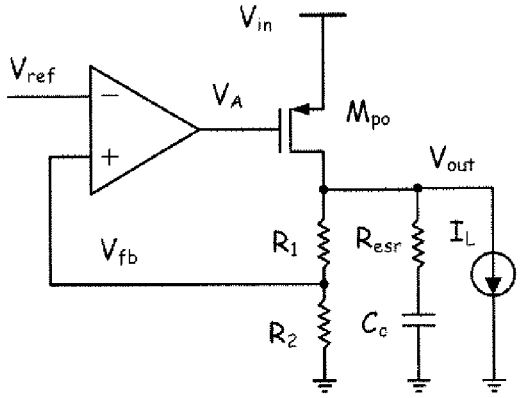
FIG. 1B (prior art)
FIG. 1B illustrates a typical topology of linear regulators in accordance with the prior art.
Figure 2A:
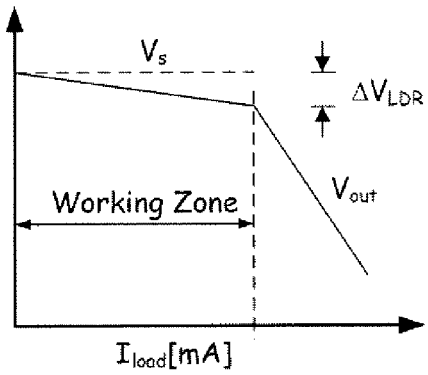
FIG. 2A (prior art)
FIG. 2A illustrates the load regulation effect in the DC domain (Load regulation effect vs. $I_{LOAD}$), in accordance with the prior art.
Figure 2B:
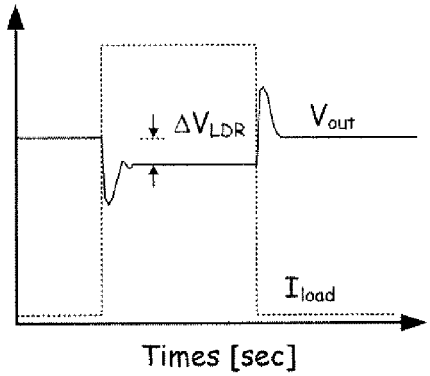
FIG. 2B (prior art)
FIG. 2B illustrates the load regulation effect in the time domain, in accordance with the prior art.
Figure 3A:
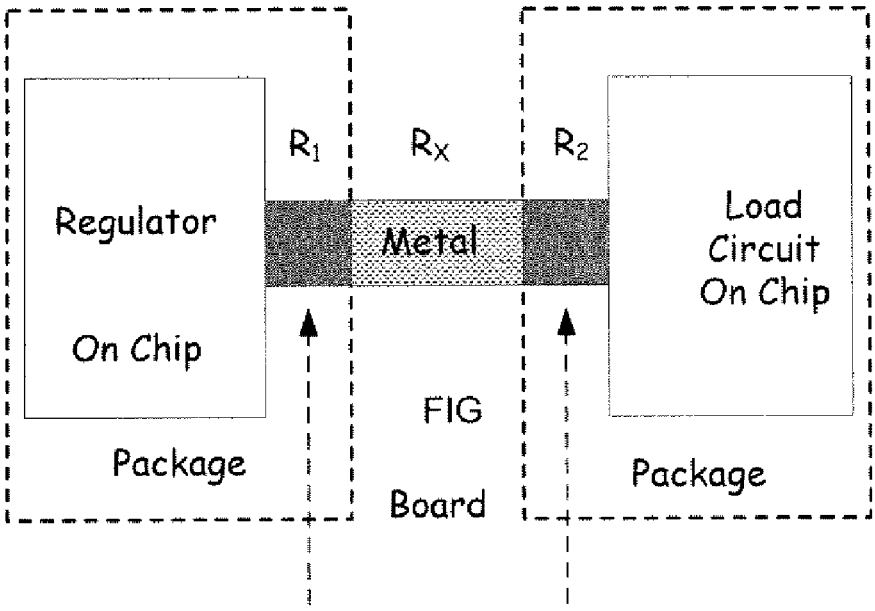
FIG. 3A (prior art)
FIGS. 3A and 3B illustrate typical connection resistance between a regulator and a load circuit where there is an on-chip connection and an off-chip connection, in accordance with the prior art.
Figure 3B:
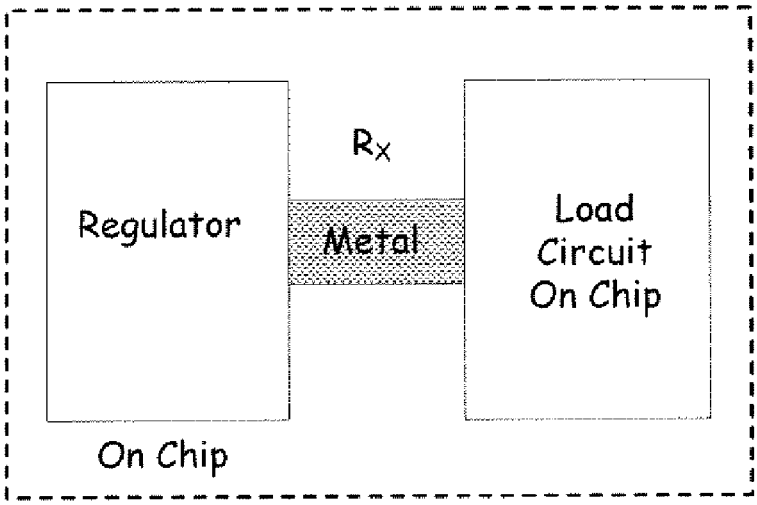
FIG. 3B (prior art)
Figure 4:
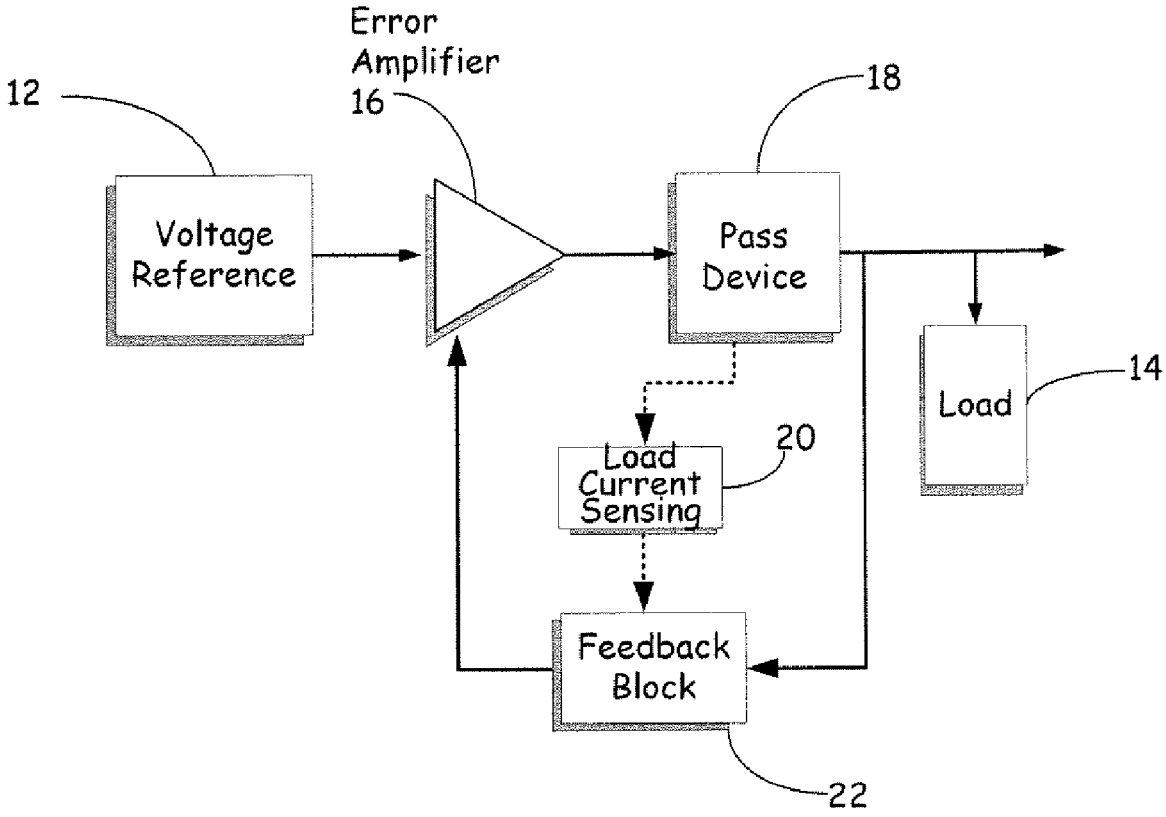
FIG. 4 illustrates a simple block diagram of the load regulation tuner, in accordance with an example embodiment of the invention.

A simple conceptual block diagram of a low drop-out voltage regulator with a load regulation tuner is shown in FIG. 4, according to an example embodiment of the invention. As shown in FIG. 4, the voltage regulator may include a voltage reference 12, an amplifier such as an error-amplifier 16, a pass device 18, and an output load 14. The voltage regulator may also include a load regulation tuner comprising a feedback block 22 and a load current sensing block 20, according to an example embodiment of the invention.

Still referring to FIG. 4, during operation of the voltage regulator, the error amplifier 16 may receive the reference voltage 12 as well as a feedback voltage from the feedback block 22. Using the voltage reference 12 and the feedback voltage, the error amplifier 16 may determine an error signal as the difference between the reference voltage 12 and the feedback voltage, according to an example embodiment of the invention. The error amplifier 16 may control a gate voltage of the pass device 18 (e.g., power transistor) that outputs the constant output voltage. The constant output voltage is provided to both the output load 14 and the feedback block 22. The feedback block 22 outputs a feedback voltage to the error amplifier 16 for use in canceling the load regulation effect. According to an example embodiment of the invention, the load current sensing block 20 may change a feedback factor of the feedback block 22 to cancel the load regulation effect to obtain a desired constant output voltage.

Figure 5:
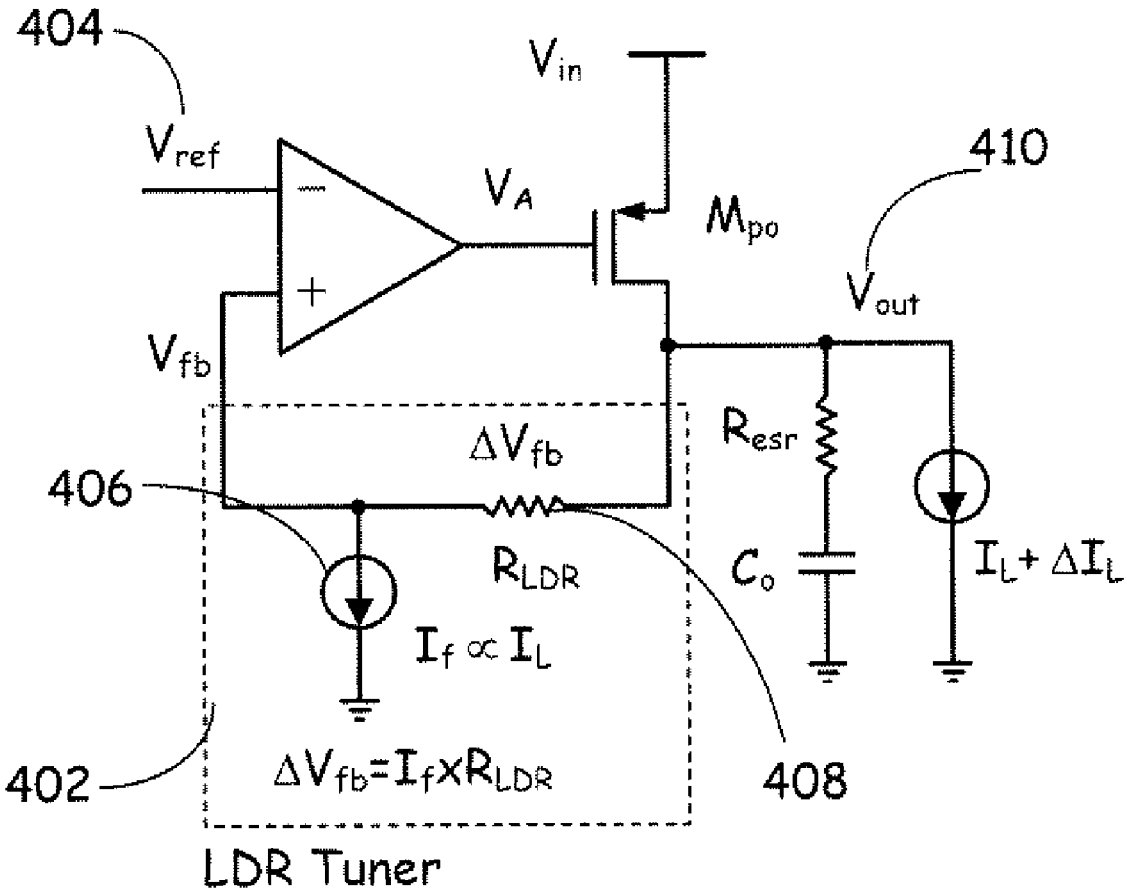
FIG. 5 illustrates a simple schematic diagram of the invention with a linear regulator in accordance with an example embodiment of the invention.

FIG. 5 illustrates a more detailed schematic diagram of a load regulation tuner 402 utilized in a voltage regulator, in accordance with an example embodiment of the invention. As shown in FIG. 5, it will be appreciated that the load regulation effect may be based upon a DC voltage difference between the actual output voltage level and the desired output voltage level (i.e., reference voltage $V_{REF}$ 404), according to an example embodiment of the invention. Referring to the input nodes, the feedback voltage difference $\Delta V_{FB}$ may be equal to $\Delta V_{LDR}*\beta$, where $\Delta V_{LDR}$ is the voltage difference across the regulator and $\beta$ is the feedback factor of the regulator. To fully cancel the load regulation effect, the load regulation (LDR) tuner 402 may need to compensate for the voltage difference $\Delta V_{FB}$ such that the output voltage $V_{OUT}$ 410 may be equal to the reference voltage $V_{REF}$ 404.

According to an example embodiment of the invention, the LDR tuner 402 may include a resistor 408 and a current controlled current source 406 to compensate for the voltage difference $\Delta V_{FB}$. In particular, the resistor 408 and current controlled current source 406 may be operative to provide a feedback voltage difference $\Delta V_{FB}$ of $\Delta V_{LDR}*\beta$. In other words, a load current controlled current source 406 with a resistor $R_{LDR}$ 408 (according to Thevenin's theorem, $\Delta V_{FB}=I_F*R_{LDR}=\Delta V_{FB}=\Delta V_{LDR}*\beta$) may be inserted into the feedback loop to cancel the load regulation effect, so the output voltage $V_{OUT}$ 410 may be exactly equal to the reference voltage $V_{REF}$ 404, as shown in FIG. 5, according to an example embodiment of the invention.

Still referring to FIG. 5, to further reduce the inter-connection voltage loss due to inter-connection resistance, the LDR tuner 402 may also compensate for the inter-connection resistance. More specifically, the current controlled current source 406 ($I_F$) and/or the resistance $R_{LDR}$ 408 may be tuned so that $\Delta V_{FB}/\beta=\Delta V_{LDR}+(R_X*\Delta I_L)$, where $R_X$ represents the inter-connection resistance and $\Delta I_L$ is the change in load current. The LDR tuner 402 may also help minimize the variations of load regulation performance over process corners for products.

Figure 6:
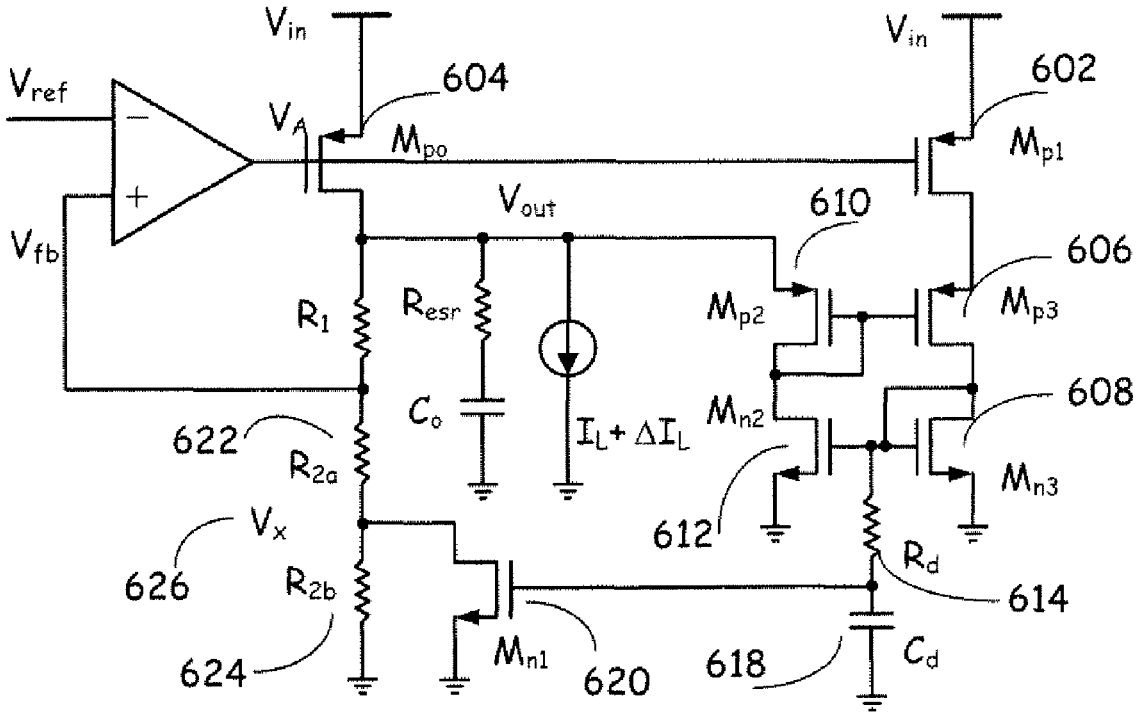
FIG. 6 illustrates an example circuit with a linear regulation tuner with feedback factor $\beta<1$, in accordance with an example embodiment of the invention.

Example embodiments of the load regulation tuner operating in conjunction with linear regulators are shown in FIG. 6. As shown in FIG. 6, capacitor $C_d$ 618 and resistor $R_d$ 614 may be inserted between the gates of the current mirror (transistors $M_{n2}$ 612 and $M_{n3}$ 608) for a time delay to make sure the response time of the load regulation tuner is slower than that of the regulator itself and further guarantee the stability of the regulator is not affected by the load regulation tuner.

The load regulation tuner of FIG. 6 may include a PMOS transistor $M_{P1}$ 602, a PMOS transistor $M_{P2}$ 610, a PMOS transistor $M_{P3}$ 606, a NMOS transistor $M_{N2}$ 612, a NMOS transistor $M_{N3}$ 608, a NMOS transistor $M_{N1}$ 612, a resistor $R_d$ 614 and a capacitor $C_d$ 618, according to an example embodiment of the invention. The gate of the PMOS transistor $M_{P1}$ 602 may be connected the gate of the PMOS power transistor $M_{p0}$ 604. The PMOS transistor $M_{p1}$ 608 may have its source connected to the supply voltage and a drain connected to the source of the PMOS transistor $M_{p3}$ 606. The PMOS transistor $M_{p3}$ 606 may have a gate connected the gate of the PMOS transistor $M_{p2}$ 610 and a drain connected to a drain of the NMOS transistor $M_{n3}$ 608. The NMOS transistor $M_{p2}$ 610 may have a source connected to a drain of the PMOS power transistor $M_{p0}$ 604, and a gate connected to its drain and a drain of the NMOS transistor $M_{n2}$ 612. The NMOS transistor $M_{n2}$ 612 may have a gate connected to a gate of the $M_{n3}$ 608 and a source connected to a ground. The NMOS transistor $M_{n3}$ 608 may have a gate connected to the gate of the NMOS transistor $M_{n2}$ 612 and a source connected to a ground. The resistor $R_d$ 614 may be connected between the gate of the transistor $M_{n3}$ 608 and a capacitor $C_d$ 618. The top plate of the capacitor $C_d$ 618 may be connected to the resistor $R_d$ 614 and a gate of the transistor $M_{n1}$ 620. The bottom plate of the capacitor $C_d$ 618 may be connected to a ground. The NMOS transistor $M_{n1}$ 620 may have a drain connected to a node $V_X$ 626, which is a junction of the resistor $R_{2a}$ 622 and $R_{2b}$ 624, and a source connected to a ground.

As shown in FIG. 6, transistors Mp1 602, $M_{P2}$ 610, $M_{P3}$ 606, $M_{N2}$ 612, $M_{N3}$ 608, capacitor $C_d$ 618 and resistor $R_d$ 614 may construct a load current sensing block such as the load current sensing block 20 of FIG. 4, according to an example embodiment of the invention. The transistor $M_{P1}$ 602 may sense the load current of the power transistor $M_{P0}$ 604. The size of the transistor $M_{P1}$ 602 may be much smaller than that of the power transistor $M_{P0}$ 604 so that only small fraction of the load current flows in the transistor $M_{P1}$ 602, according to an example embodiment of the invention. The feedback composed with $M_{P2}$ 610, $M_{P3}$ 606, $M_{N2}$ 612, $M_{N3}$ 608 may ensure that the current in both branches are equal or substantially equal, according to an example embodiment of the invention. It also improves the accuracy of the ratio between the load current of the transistor $M_{P0}$ 604 and the sensed current of the transistor $M_{P1}$ 602 because the feedback ensures the drain-source voltage of the transistors $M_{P0}$ 604 and $M_{P1}$ 602 are equal or substantially equal. The overall current consumption of the load regulation tuner may be very minimal. When load current changes, the current flow in the transistor $M_{P1}$ may change as well as the gate-source voltage of the transistor $M_{N3}$ 608 causing the output resistance of the transistor $M_{N1}$ 620 to change. This leads the feedback factor to vary to cancel the load regulation effect so that the desired output voltage of the regulator is achieved.

As shown in FIG. 6, the operation of this load regulation tuner can be controlled by adjusting the size of transistor $M_{N1}$ 620 and resistance $R_{2b}$ 624 to suit different loading environments and applications. The load regulation tuner may tune the DC feedback factor of the voltage regulator to cancel the load regulation effect and the inter-connection voltage loss due to the inter-connection resistance without affecting the frequency response and PSRR performance of the regulator.

In the example embodiment of the invention shown in FIG. 6, the feedback circuit may include a resistor ladder composed of $R_{2a}$ 622 and $R_{2b}$ 624. In alternative embodiments of the invention, the feedback circuit should be verified by checking whether the load regulation is fully cancelled in the regulator output. It will be appreciated that the load regulator of FIG. 6 is operative to generate $\Delta V_{FB}$ o cancel the voltage difference ($\Delta V_{LDR}$) between the desired output voltage and the actual output voltage with increased output current $\Delta I_L$. According to an example embodiment of the invention, $\Delta V_{FB}$ may be generated by $R_1$, $R_{2a}$, $R_{2b}$ and Mn1 with sensed load current, as illustrated in FIG. 6.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A load regulation tuner comprising:

a load current controlled current source that is responsive to a load current from a power transistor of a linear regulator, and a resistor in parallel with the load current controlled current source, wherein the paralleled resistor and the load current controlled current source form at least a portion of a feedback block that adjusts an operation of the linear regulator to provide a substantially constant load voltage, and wherein the load current controlled current source includes:

a sensing transistor that generates a fraction of the load current as a sensed partial load current, and a current mirror connected to the sensing transistor and the power transistor for ensuring a substantially equal drain voltage for the sensing transistor and power transistor, thereby enhancing an accuracy of the sensing transistor in generating the fraction of the load current as the sensed partial load current.

2. The load regulation tuner of claim 1, wherein at least one of the paralleled resistor and the load current controlled current source are adjusted to compensate for a voltage difference across the linear regulator.

3. The load regulation tuner of claim 1, wherein the linear regulator further includes an error amplifier, and wherein an output of the error amplifier is provided as input to the power transistor of the linear regulator.

4. The load regulation tuner of claim 3, wherein the error amplifier includes a reference voltage input and a feedback voltage input, wherein the feedback voltage input is provided from the feedback block.

5. The load regulation tuner of claim 1, wherein the sensing transistor and the power transistor include substantially equal drain-source voltages.

6. The load regulation tuner of claim 1, wherein the current mirror comprises at least two transistors having gates that are connected to each other, and further comprising one or both of a delay resistor and a delay capacitor connected to gates of the at least two transistors.

7. The load regulation tuner of claim 6, wherein one or both of the delay resistor and the delay capacitor are connected to a third transistor of the feedback block.

8. The load regulation tuner of claim 1, wherein the at least a portion of the feedback block further comprises a resistor ladder that includes the paralleled resistor.

9. A method for providing a load regulation tuner comprising:

providing a current source that is responsive to a load current from a power transistor of a linear regulator; and providing a resistor in parallel with the current source, wherein the paralleled resistor and the current source form at least a portion of a feedback block that adjusts an operation of the linear regulator to provide a substantially constant load voltage, and wherein the current source includes a sensing transistor that generates a fraction of the load current as a sensed partial load current, and a current mirror connected to the sensing transistor and the power transistor, thereby ensuring an accuracy of the sensing transistor in generating the fraction of the load current as the sensed partial load current.

10. The method of claim 9, wherein the paralleled resistor and the current source are adjusted to compensate for a voltage difference across the linear regulator.

11. The method of claim 9, wherein the linear regulator further includes an error amplifier, and wherein an output of the error amplifier is provided as input to the power transistor of the linear regulator.

12. The method of claim 11, further comprising providing a feedback voltage input to the error amplifier from the feedback block.

13. The method of claim 9, wherein the sensing transistor and the power transistor include substantially equal drain-source voltages.

14. The method of claim 9, wherein the current mirror comprises at least two transistors having gates that are connected to each other, and further comprising connecting one or both of a delay resistor and a delay capacitor to the gates of the at least two transistors.

15. The method of claim 14, further comprising providing a third transistor for the feedback block, wherein the third transistor is connected to one or both of the delay resistor and the delay capacitor.

16. The method of claim 9, wherein at least a portion of the feedback block comprises a resistor ladder that includes the paralleled resistor.

* * * * *